US011649686B2

(12) United States Patent
McChesney et al.

(10) Patent No.: US 11,649,686 B2
(45) Date of Patent: May 16, 2023

(54) FLUID FLOW CONTROL DEVICES AND METHODS TO REDUCE OVERSPEED OF A FLUID FLOW CONTROL DEVICE

(71) Applicant: Halliburton Energy Services, Inc., Houston, TX (US)

(72) Inventors: Ryan Wesley McChesney, Prosper, TX (US); Stephen Michael Greci, Little Elm, TX (US); Richard Decena Ornelaz, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 161 days.

(21) Appl. No.: 17/128,948

(22) Filed: Dec. 21, 2020

(65) Prior Publication Data

US 2022/0195821 A1 Jun. 23, 2022

(51) Int. Cl.

| | |
|---|---|
| ***E21B 21/10*** | (2006.01) |
| ***E21B 43/12*** | (2006.01) |
| ***F01D 21/02*** | (2006.01) |
| ***E21B 21/08*** | (2006.01) |

(52) U.S. Cl.

CPC ..... *E21B 21/08* (2013.01); *E21B 21/103* (2013.01); *F01D 21/02* (2013.01)

(58) Field of Classification Search

CPC ..... E21B 21/103; E21B 43/12; F01D 21/02
See application file for complete search history.

(56) References Cited

U.S. PATENT DOCUMENTS

| | | | | |
|---|---|---|---|---|
| 4,507,047 | A * | 3/1985 | Coons | F01D 21/02 416/2 |
| 4,509,896 | A * | 4/1985 | Linsker | F01D 21/045 415/18 |
| 6,854,953 | B2 | 2/2005 | Van Drentham-Susman et al. | |
| 7,988,409 | B2 | 8/2011 | Moriarty | |
| 9,551,186 | B2 * | 1/2017 | Amsellem | E21B 41/0085 |
| 9,765,636 | B2 | 9/2017 | Scholz | |
| 2008/0156477 | A1 * | 7/2008 | Aivalis | E21B 41/0085 166/53 |
| 2020/0308927 | A1 | 10/2020 | Fripp et al. | |
| 2021/0131209 | A1 * | 5/2021 | He | E21B 47/12 |

FOREIGN PATENT DOCUMENTS

| | | | | |
|---|---|---|---|---|
| CN | 1604433 | A | 4/2005 | |
| CN | 212055581 | U | 12/2020 | |
| JP | 2011-094574 | A | 5/2011 | |
| KR | 10-0996130 | B1 | 11/2010 | |
| WO | 2019078821 | | 4/2019 | |
| WO | 2019135814 | | 7/2019 | |
| WO | WO-2019135814 | A1 * | 7/2019 | E21B 34/08 |
| WO | 2020081070 | | 4/2020 | |

OTHER PUBLICATIONS

International Search Report dated Sep. 8, 2021; International PCT Application No. PCT/US2020/066600.

* cited by examiner

*Primary Examiner* — Matthew R Buck

(74) *Attorney, Agent, or Firm* — Barnes & Thornburg, LLP

(57) ABSTRACT

Fluid flow control devices and methods to reduce overspeed of a fluid flow control device are presented. A fluid flow control device includes a port and a rotatable component that rotates about an axis in response to fluid flow from the port. The fluid flow control device also includes a mechanical component disposed on the rotatable component and configured to reduce rotational speed of the rotatable component.

19 Claims, 12 Drawing Sheets

FLUID FLOW CONTROL DEVICES AND METHODS TO REDUCE OVERSPEED OF A FLUID FLOW CONTROL DEVICE

BACKGROUND

The present disclosure relates generally to fluid flow control devices and methods to reduce overspeed of a fluid flow control device.

Wellbores are sometimes drilled from the surface of a wellsite several hundred to several thousand feet downhole to reach hydrocarbon resources. During certain well operations, such as production operations, certain fluids, such as fluids of hydrocarbon resources, are extracted from the formation, where fluids of hydrocarbon resources flow into one or more sections of a conveyance such as a section of a production tubing, and through the production tubing, uphole to the surface. During production operations, other types of fluids, such as water, sometimes also flow into the section of production tubing while fluids of hydrocarbon resources are being extracted.

BRIEF DESCRIPTION OF THE DRAWINGS

Illustrative embodiments of the present disclosure are described in detail below with reference to the attached drawing figures, which are incorporated by reference herein, and wherein.

Figure 1:
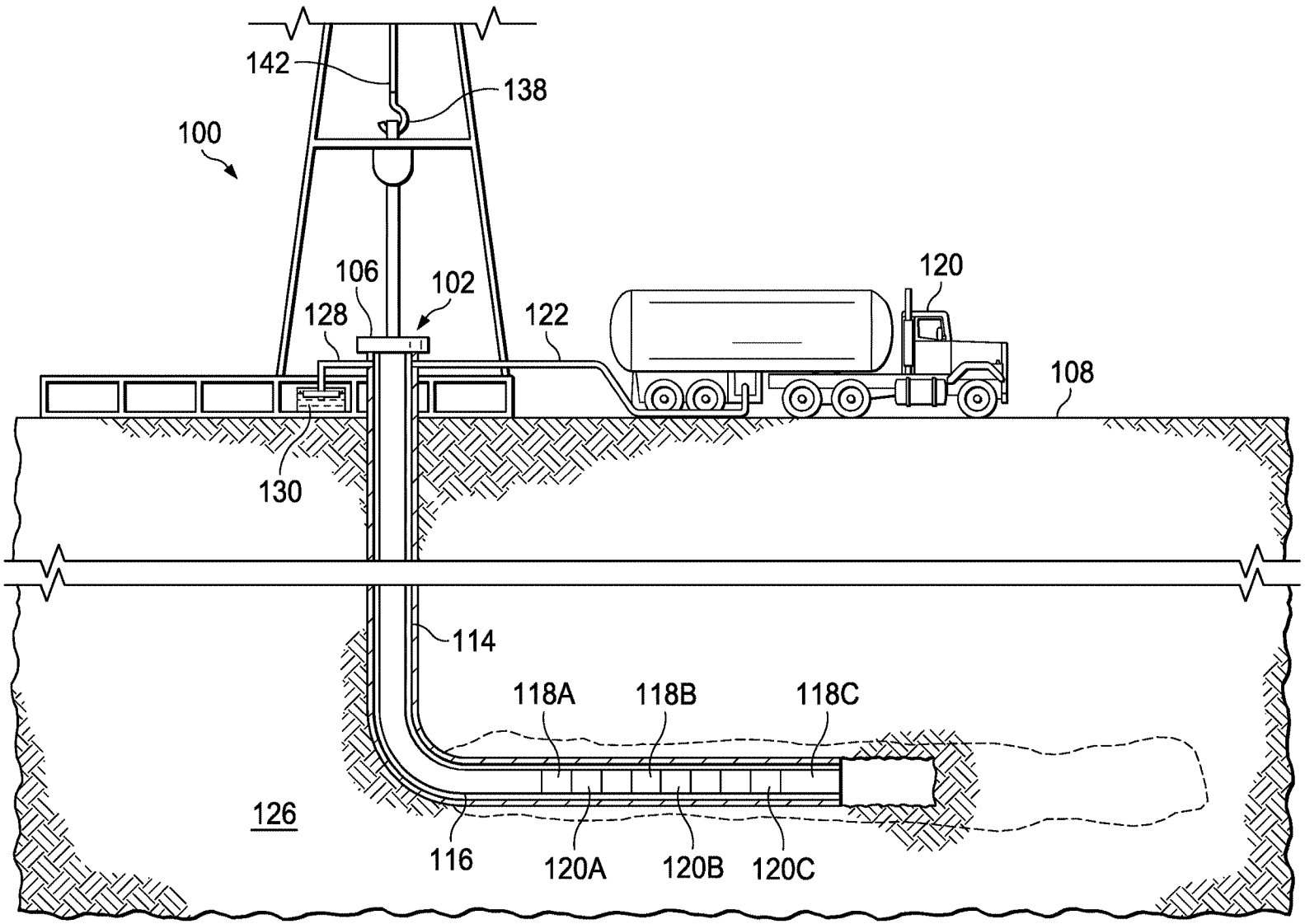
FIG. 1 is a schematic, side view of a well environment in which three inflow flow control devices are deployed in a wellbore.

The illustrated figures are only exemplary and are not intended to assert or imply any limitation with regard to the environment, architecture, design, or process in which different embodiments may be implemented.

DETAILED DESCRIPTION

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure relates to fluid flow control devices and methods to reduce overspeed of a fluid flow control device. The fluid flow control device includes a port, such as an inlet port, and a rotatable component that rotates about an axis in response to fluid flow from the port. As referred to herein, a rotatable component is any component or device that is rotatable about an axis. Examples of rotatable components include, but are not limited to, rotatable turbines, rotatable wheels, as well as other objects that are rotatable about an axis. In some embodiments, force applied by fluids flowing through the inlet port during certain operations, such as drilling operations, fracturing operations, and production operations, rotate the rotatable component. The fluid flow control device also includes an outlet port that provides a fluid passageway out of the rotatable component.

In some embodiments, the fluid flow control device has a chamber disposed within the fluid flow control device. In one or more of such embodiments, a weight and a spring that is coupled to or is positioned near the weight are disposed in the chamber. Moreover, as the rotatable component rotates at a faster speed (e.g., greater than a threshold speed), a centrifugal force applied to the weight shifts the weight in a radial direction towards the spring. As referred to herein, radially inwards means shifting radially towards the center, such as the central axis of a rotatable component, whereas radially outwards means shifting away from the center, such as away from the central axis of the rotatable component and towards the parameters of the rotatable component. The movement of the weight from an initial position to a second position radially outwards from the initial position also increases the radius of gyration of the rotatable component. The increase in the radius of gyration dampens or reduces the rotational acceleration of the rotatable component, thereby reducing overspeed of the rotatable component. In some embodiments, moving the weights away from an axis of rotation of the rotatable component increases the moment of inertia of the rotatable component, which in turn increases the threshold amount of energy to further accelerate the rotatable component. However, moving the weights increases the moment of inertia without inputting additional energy onto the rotatable component, which in turn reduces or dampens the acceleration of the rotatable component. A force applied by movement of the weight onto the spring also compresses the spring. As the acceleration of the rotatable component dampens, or as the speed of the rotatable component decreases, the force of the compressed spring onto the weight supersedes the centrifugal force, and shifts the weight radially inwards, towards the original position of the weight, and returning the spring to a natural state.

In some embodiments, the chamber is partially filled with a fluid, such as water, brine, low melting point metals, or fluids having a density that is greater than a threshold density. In one or more of such embodiments, as the rotatable component rotates at a faster speed, a centrifugal force applied to the fluid shifts the fluid from a first region of the chamber, radially outwards, to a second region of the chamber that is further away from the axis of the rotatable component relative to the first region. The radially outward movement of the fluid from the first region to the second region of the chamber also increases the radius of gyration of the rotatable component. The increase in the radius of gyration dampens the rotational acceleration of the rotatable component, thereby reducing overspeed of the rotatable component.

In some embodiments, the downhole rotatable system utilizes one or more mechanical components to reduce the speed of the rotatable component and/or to dampen the acceleration of the rotatable component. As referred to here, a mechanical component includes any mechanical element that is utilized or actuated to reduce the speed or to dampen the acceleration of the rotatable component. In some embodiments, the mechanical element is a protrusion that extends radially outwards from an initial position to a second position in response to an increase in the rotational speed of the rotatable component, and/or in response to the rotational speed of the rotatable component being greater than a threshold speed. Examples of protrusions include, but are not limited to, pins, screws, rods, and other elements or components that are shiftable from an initial position to a second position.

In one or more of such embodiments, as the rotational speed of the rotatable component increases, a centrifugal force applied to the protrusion shifts the protrusion from the initial position, radially outwards, to a second position, where the protrusion engages an element of the fluid flow control device to reduce the speed at which the rotatable component rotates. In one or more of such embodiments, the element is a wall of a housing of the fluid flow control device or a surface of another component of the fluid flow control device that the protrusion engages when the protrusion shifts to the second position. In one or more of such embodiments, the element is another protrusion disposed on the wall of the housing or on another component of the fluid flow control device. Additional descriptions of the protrusion and element are provided herein and are illustrated in at least FIGS. 5A-5B. In one or more of such embodiments, the protrusion is coupled to or positioned near a spring. A force applied by movement of the weight onto the spring also compresses the spring. As the rotatable component decelerates and/or as the rotational speed of the rotatable component decreases, the force of the compressed spring compression onto the protrusion supersedes the centrifugal force, and shifts the protrusion radially inwards, towards the original position of the protrusion, and returning the spring to a natural state.

In some embodiments, the rate at which fluids flow out of an inlet port and onto the rotatable component is adjusted to reduce the speed of the rotatable component and/or to dampen the acceleration of the rotatable component. In one or more of such embodiments, the inlet port is placed in a position where increasing the flow rate of fluids flowing out of the inlet port decreases the Coanda effect on the fluid, such that less fluids flowing out of the inlet port flow directly onto the rotatable component. In one or more of such embodiments, a nozzle of inlet port is adjusted to increase the flow rate of fluids flowing out of the inlet port. In one or more of such embodiments, pressure is applied to the fluids to increase the flow rate of the fluid out of the inlet port. Additional descriptions of increasing the flow rate of fluids flowing out of the inlet port are provided herein and are illustrated in at least FIGS. 6A-6B.

In some embodiments, one or more fins are installed on top of the rotatable component at a pitch (e.g., 30°, 45°, or another pitch), such that, as the rotatable component rotates, the top fins generate a resultant downward force, which pushes rotatable component against a thrust bearing, on which, rotatable component rotates, which in turn increases friction between the thrust bearing and the rotatable component. In some embodiments, the rotatable component includes or is coupled to one or more fins that extend radially outwards from the rotatable component. Moreover, each fin has an adjustable pitch that is adjustable based on the amount of force the fluids apply onto the respective fin. In one or more of such embodiments, the pitch is adjusted to an angle that causes the fin to come in contact with a less amount of fluids, thereby reducing the amount of force applied to the fin. Additional examples of fins having adjustable pitches are provided herein and are illustrated in at least FIGS. 8A and 8B.

In some embodiments, the fluid flow control device also includes a float that is positioned within the rotatable component of the fluid flow control device. The float is shiftable from an open position to a closed position that restricts fluid flow through the outlet port while the float is in the closed position, and from the closed position to the open position to permit fluid flow through the outlet port. As referred to herein, an open position is a position of the float where the float does not restrict fluid flow through the outlet port, whereas a closed position is a position of the float where the float restricts fluid flow through the outlet port. In some embodiments, the float shifts radially inwards towards the outlet port to move from an open position to a closed position, and shifts radially outwards away from the outlet port to move from the closed position to the open position. In some embodiments, the float opens to permit certain types of fluids having densities that are less than a threshold (such as oil and other types of hydrocarbon resources) to flow through the outlet port, and restricts other types of fluids having densities greater than or equal to the threshold (such as water and drilling fluids) from flowing through the outlet port. Additional descriptions of fluid flow control devices and methods to reduce overspeed of a fluid flow control device are provided in the paragraphs below and are illustrated in FIGS. 1-10.

Turning now to the figures, FIG. 1 is a schematic, side view of a well environment 100 in which inflow control devices 120A-120C are deployed in a wellbore 114. As shown in FIG. 1, wellbore 114 extends from surface 108 of well 102 to or through formation 126. A hook 138, a cable 142, traveling block (not shown), and hoist (not shown) are provided to lower conveyance 116 into well 102. As referred to herein, conveyance 116 is any piping, tubular, or fluid conduit including, but not limited to, drill pipe, production tubing, casing, coiled tubing, and any combination thereof. Conveyance 116 provides a conduit for fluids extracted from formation 126 to travel to surface 108. In some embodiments, conveyance 116 additionally provides a conduit for fluids to be conveyed downhole and injected into formation 126, such as in an injection operation. In some embodiments, conveyance 116 is coupled to a production tubing that is arranged within a horizontal section of well 102. In the embodiment of FIG. 1, conveyance 116 and the production tubing are represented by the same tubing.

At wellhead 106, an inlet conduit 122 is coupled to a fluid source 120 to provide fluids through conveyance 116 downhole. For example, drilling fluids, fracturing fluids, and injection fluids are pumped downhole during drilling operations, hydraulic fracturing operations, and injection operations, respectively. In the embodiment of FIG. 1, fluids are circulated into well 102 through conveyance 116 and back toward surface 108. To that end, a diverter or an outlet conduit 128 may be connected to a container 130 at the wellhead 106 to provide a fluid return flow path from wellbore 114. Conveyance 116 and outlet conduit 128 also form fluid passageways for fluids, such as hydrocarbon resources to flow uphole during production operations.

In the embodiment of FIG. 1, conveyance 116 includes production tubular sections 118A-118C at different production intervals adjacent to formation 126. In some embodiments, packers (now shown) are positioned on the left and right sides of production tubular sections 118A-118C to define production intervals and provide fluid seals between the respective production tubular section 118A, 118B, or 118C, and the wall of wellbore 114. Production tubular sections 118A-118C include inflow control devices 120A-120C (ICDs). An inflow control device controls the volume or composition of the fluid flowing from a production interval into a production tubular section, e.g., 118A. For example, a production interval defined by production tubular section 118A produces more than one type of fluid component, such as a mixture of water, steam, carbon dioxide, and natural gas. Inflow control device 120A, which is fluidly coupled to production tubular section 118A, reduces or restricts the flow of fluid into the production tubular section 118A when the production interval is producing a higher proportion of an undesirable fluid component, such as water, which permits the other production intervals that are producing a higher proportion of a desired fluid component (e.g., oil) to contribute more to the production fluid at surface 108 of well 102, so that the production fluid has a higher proportion of the desired fluid component. In some embodiments, inflow control devices 120A-120C are an autonomous inflow control devices (AICD) that permits or restricts fluid flow into the production tubular sections 118A-118C based on fluid density, without requiring signals from the well's surface by the well operator.

Although the foregoing paragraphs describe utilizing inflow control devices 120A-120C during production, in some embodiments, inflow control devices 120A-120C are also utilized during other types of well operations to control fluid flow through conveyance 116. Further, although FIG. 1 depicts each production tubular section 118A-118C having an inflow control device 120A-120C, in some embodiments, not every production tubular section 118A-118C has an inflow control device 120A-120C. In some embodiments, production tubular sections 118A-118C (and inflow control devices 120A-120C) are located in a substantially vertical section additionally or alternatively to the substantially horizontal section of well 102. Further, any number of production tubular sections 118A-118C with inflow control devices 120A-120C, including one, are deployable well 102. In some embodiments, production tubular sections 118A-118C with inflow control devices 120A-120C are disposed in simpler wellbores, such as wellbores having only a substantially vertical section. In some embodiments, inflow control devices 120A-120C are disposed in cased wells or in open-hole environments.

Figure 2:
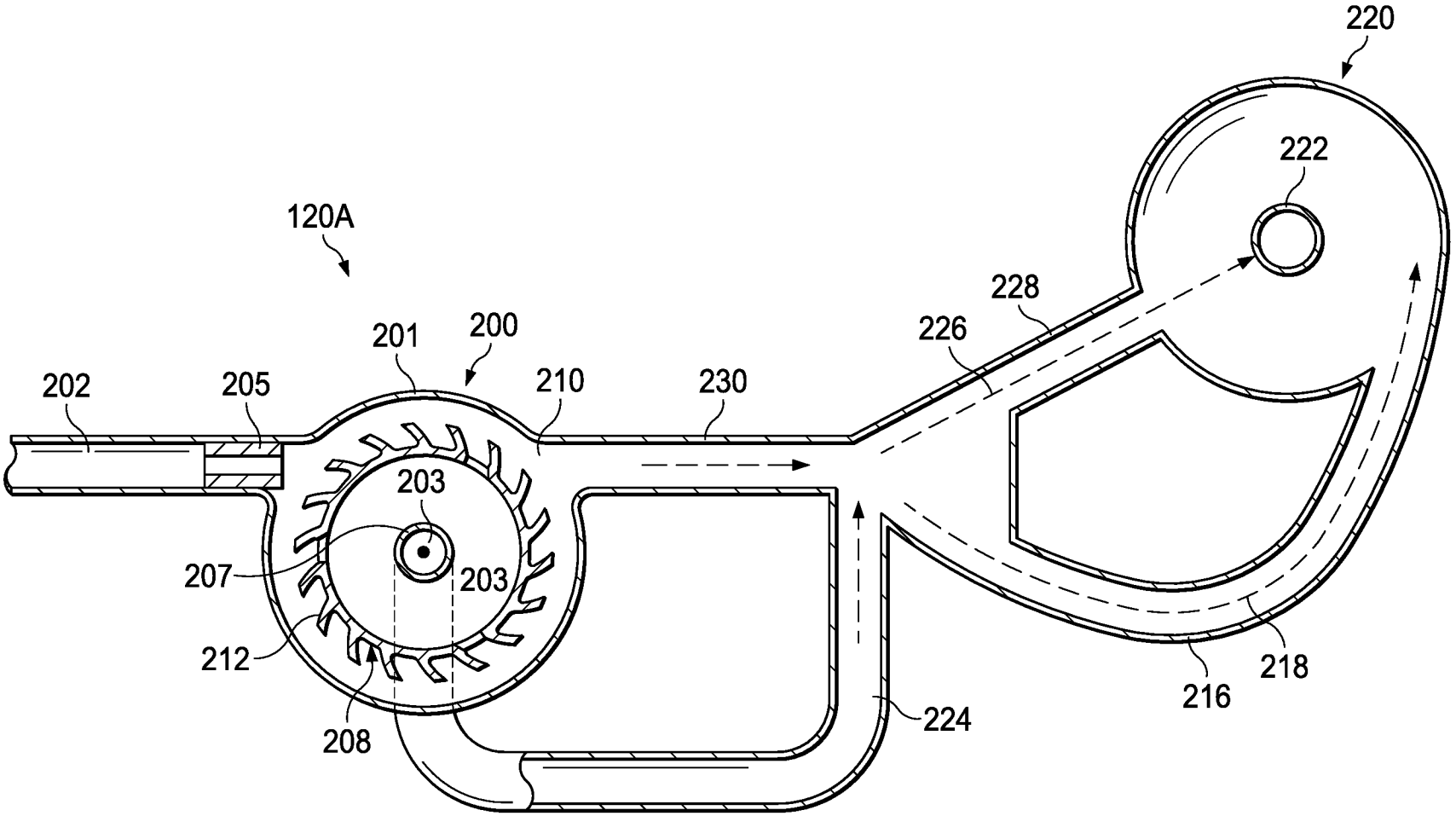
FIG. 2 is a cross-sectional view of a portion of a flow control device of FIG. 1.

FIG. 2 is a cross-sectional view of a portion of inflow control device 120A of FIG. 1. In the embodiments described herein, inflow control device 120A includes an inflow tubular 200 of a well tool coupled to a fluid flow control device 202. Although the word "tubular" is used to refer to certain components in the present disclosure, those components have any suitable shape, including a non-tubular shape. Inflow tubular 200 provides fluid to fluid flow control device 202. In some embodiments, fluid is provided from a production interval in a well system or from another location. In the embodiment of FIG. 2, inflow tubular 200 terminates at an inlet port 205 that provides a fluid communication pathway into fluid flow control device 202. In some embodiments, inlet port 205 is an opening in a housing 201 of fluid flow control device 202.

A first fluid portion flows from inlet port 205 toward a bypass port 210. The first fluid portion pushes against fins 212 extending outwardly from a rotatable component 208 to rotate rotatable component 208 to rotate about an axis, such as a central axis 203. Rotation of rotatable component 208 about axis 203 generates a force on a float (not shown) positioned within rotatable component 208. After passing by rotatable component 208, the first fluid portion exits fluid flow control device 202 via bypass port 210. From bypass port 210, the first fluid portion flows through a bypass tubular 230 to a tangential tubular 216. The first fluid portion flows through tangential tubular 216, as shown by dashed arrow 218, into a vortex valve 220. In the embodiment of FIG. 2, the first fluid portion to spin around an outer perimeter of vortex valve 220 at least partially due to the angle at which the first fluid portion enters vortex valve 220. Forces act on the first fluid portion, eventually causing the first fluid portion to flow into a central port 222 of vortex valve 220. The first fluid portion then flows from central port 222 elsewhere, such as to a well surface as production fluid.

At the same time, a second fluid portion from inlet port 205 flows into rotatable component 208 via holes in rotatable component 208 (e.g., holes between fins 212 of rotatable component 208). If the density of the second fluid portion is high, the float moves to a closed position, which prevents the second fluid portion from flowing to an outlet port 207, and instead cause the second fluid portion to flow out bypass port 210. If the density of the second fluid portion is low (e.g., if the second fluid portion is mostly oil or gas), then the float moves to an open position that allows the second fluid portion to flow out the outlet port 207 and into a control tubular 224. In this manner, fluid flow control device 202 autonomously directs fluids through different pathways based on the densities of the fluids. The control tubular 224 directs the second fluid portion, along with the first fluid portion, toward central port 222 of vortex valve 220 via a more direct fluid pathway, as shown by dashed arrow 226 and defined by tubular 228. The more direct fluid pathway to central port 222 allows the second fluid portion to more directly flow into central port 222, without first spinning around the outer perimeter of vortex valve 220. If the bulk of the fluid enters vortex valve 220 along the pathway defined by dashed arrow 218, then the fluid will tend to spin before exiting through central port 222 and will have a high fluid resistance. If the bulk of the fluid enters vortex valve 220 along the pathway defined by dashed arrow 226, then the fluid will tend to exit through central port 222 without spinning and will have minimal flow resistance.

In some embodiments, the above-mentioned concepts are enhanced by the rotation of rotatable component 208. Typically, the buoyancy force generated by the float is small because the difference in density between the lower-density fluid and the higher-density fluid is generally small, and there is only a small amount (e.g., 5 milli-Newtons) of gravitational force acting on this difference in density. This makes fluid flow control device 202 sensitive to orientation, which causes the float to get stuck in the open position or the closed position. However, rotation of rotatable component 208 creates a force (e.g., a centripetal force or a centrifugal force) on the float. The force acts as artificial gravity that is much higher than the small gravitational force naturally acting on the difference in density. This allows fluid flow control device 202 to more reliably toggle between the open and closed positions based on the density of the fluid. This also makes fluid flow control device 202 perform in a manner that is insensitive to orientation, because the force generated by rotatable component 208 is much larger than the naturally occurring gravitational force.

In some embodiments, fluid flow control device 202 directs a fluid along the more direct pathway shown by dashed arrow 226 or along the tangential pathway shown by dashed arrow 218. In one or more of such embodiments, whether fluid flow control device 202 directs the fluid along the pathway shown by dashed arrow 226 or the dashed arrow 218 depends on the composition of the fluid. Directing the fluid in this manner causes the fluid resistance in vortex valve 220 to change based on the composition of the fluid.

In some embodiments, fluid flow control device 202 is compatible with any type of valve. For example, although FIG. 2 includes a vortex valve 220, in other embodiments, vortex valve 220 is replaced with other types of fluidic valves, including valves that have a moveable valve-element, such as a rate controlled production valve. Further, in some embodiments, fluid control device 202 operates as a pressure sensing module in a valve.

Figure 3:
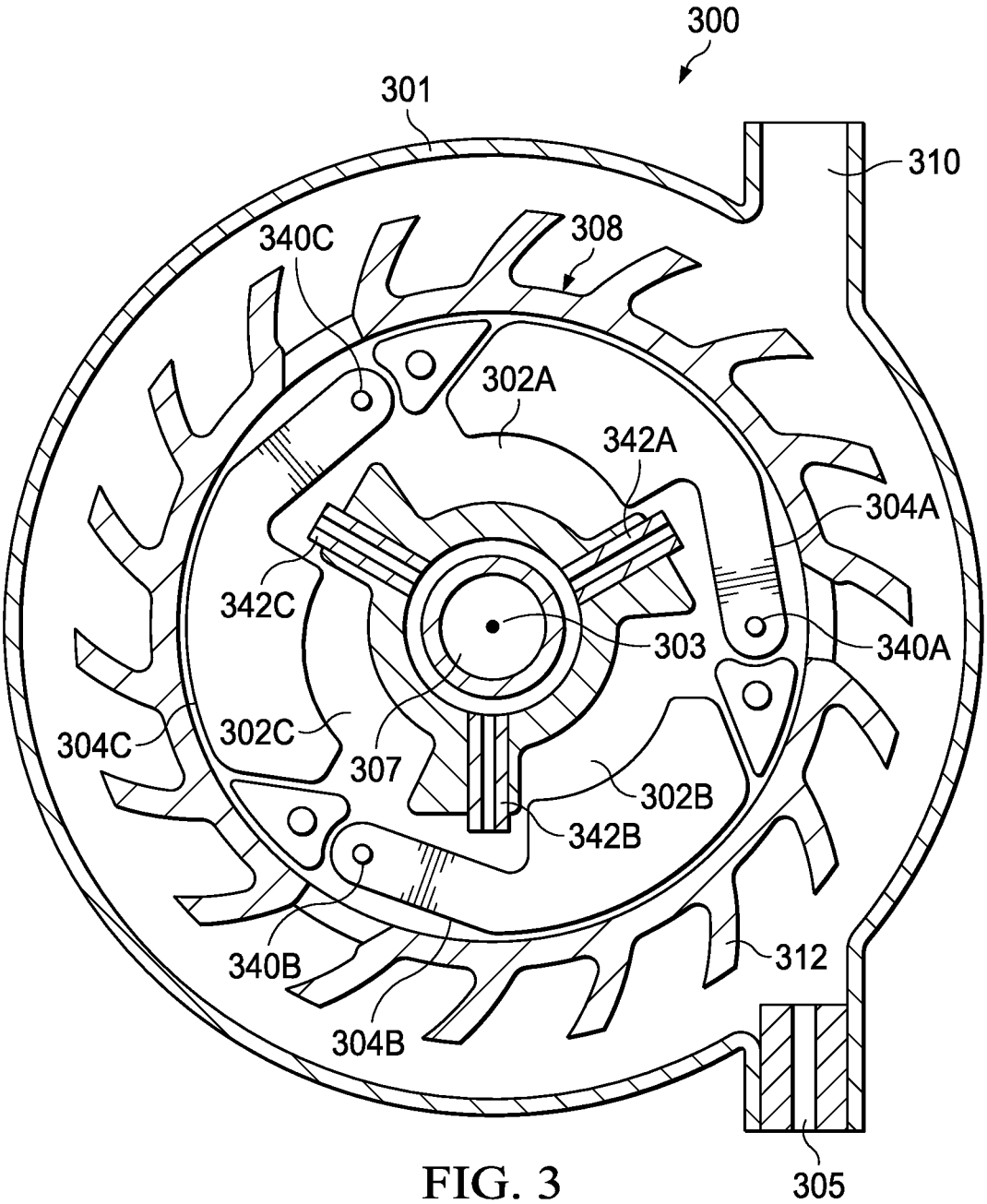
FIG. 3 is a cross-sectional view of a fluid flow control device similar to the fluid flow control device of FIG. 2.

FIG. 3 is a cross-sectional view of a fluid flow control device 300 similar to fluid flow control device 200 of FIG. 2. With reference now to FIG. 3, fluid flow control device 300 includes a rotatable component 308 positioned within a housing 301 of fluid flow control device 300. Fluid flow control device 300 also includes an inlet port 305 that provides a fluid passage for fluids such as, but not limited to, hydrocarbon resources, wellbore fluids, water, and other types of fluids to flow into housing 301. Fluid control device 300 also includes an outlet port 310 that provides a fluid flow path for fluids to flow out of fluid flow control device 300, such as to vortex valve 220 of FIG. 2. Some of the fluids that flow into housing 301 also come into contact with rotatable component 308, where force generated by fluids flowing onto rotatable component 308 rotates rotatable component 308 about axis 303. In some embodiments, fluids flowing through inlet port 305 push against fins, including fin 312, which are coupled to rotatable component 308, where the force of the fluids against the fins rotates rotatable component 308 about axis 303. Three floats 304A-304C are positioned within the rotatable component 308 and are connected to the rotatable component 308 by hinges 340A-340C, respectively, where each hinge 340A, 340B, and 340C provides for movement of a respective float 304A, 304B, and 304C relative to rotatable component 308 between the open and closed positions. In some embodiments, movements of each float 304A, 304B, and 304C between the open and the closed positions are based on fluid densities of fluids in rotatable component 308.

In some embodiments, movement of floats 304A-304C back and forth between the open and closed positions is accomplished by hinging each respective float 304A, 304B, or 304C on its hinge 340A, 340B, or 340C. In some embodiments, each hinge 340A, 340B, and 340C includes a pivot rod (not shown) mounted to rotatable component 308 and passing at least partially through float 304A, 304B, and 304C, respectively. In some embodiments, in lieu of the pivot rod mounted to rotatable component 308, each float 304A, 304B, and 304C has bump extensions that fit into recesses of rotatable component 308 for use as a hinge. In some embodiments, floats 304A-304C are configured to move back and forth from the open and closed positions in response to changes in the average density of fluids, including mixtures of water, hydrocarbon gas, and/or hydrocarbon liquids, introduced at inlet port 305. For example, floats 304A-304C are movable from the open position to the closed position in response to the fluid from inlet port 305 being predominantly water, wherein the float component is movable from the closed position to the open position in response to the fluid from the inlet port 305 being predominantly a hydrocarbon.

In the embodiment of FIG. 3, rotatable component 308 includes three fluid pathways 342A-342C that provide fluid communication between inlet port 305 and an outlet port 307. Further, each fluid pathway 342A, 342B, and 342C is fluidly connected to a chamber 302A, 302B, and 302C, respectively. Moreover, each float 304A, 304B, and 304C is disposed in a chamber 302A, 302B, and 302C, respectively, such that shifting a float 304A, 304B, or 304C from an open position to a closed position restricts fluid flow through a corresponding fluid pathway 342A, 342B, or 342C, respectively, whereas shifting float 304A, 304B, or 304C from the closed position to the open position permits fluid flow through corresponding fluid pathway 342A, 342B, or 342C. In some embodiments, float 304A, 304B, or 304C permits or restricts fluid flow through fluid pathway 342A, 342B, or 342C, respectively, based on the density of the fluid in chamber 302A, 302B, or 302C, respectively. Although FIG. 3 illustrates three floats 304A-304C positioned in three chambers 302A-202C, respectively, in some embodiments, a different number of floats positioned in a different number of chambers are placed in rotatable component 308. Further, although FIG. 3 illustrates three fluid pathways 342A-342C, in some embodiments, rotatable component 308 includes a different number of fluid pathways that fluidly connect inlet port 305 to outlet port 307. Further, although FIG. 3 illustrates three floats 304A-304C positioned in three chambers 302A-202C, respectively, in some embodiments, a different number of floats positioned in a different number of chambers are placed in rotatable component 308. Further, although FIG. 3 illustrates three fluid pathways 342A-342C, in some embodiments, rotatable component 308 includes a different number of fluid pathways that fluidly connect inlet port 305 to outlet port 307.

Figure 4A:
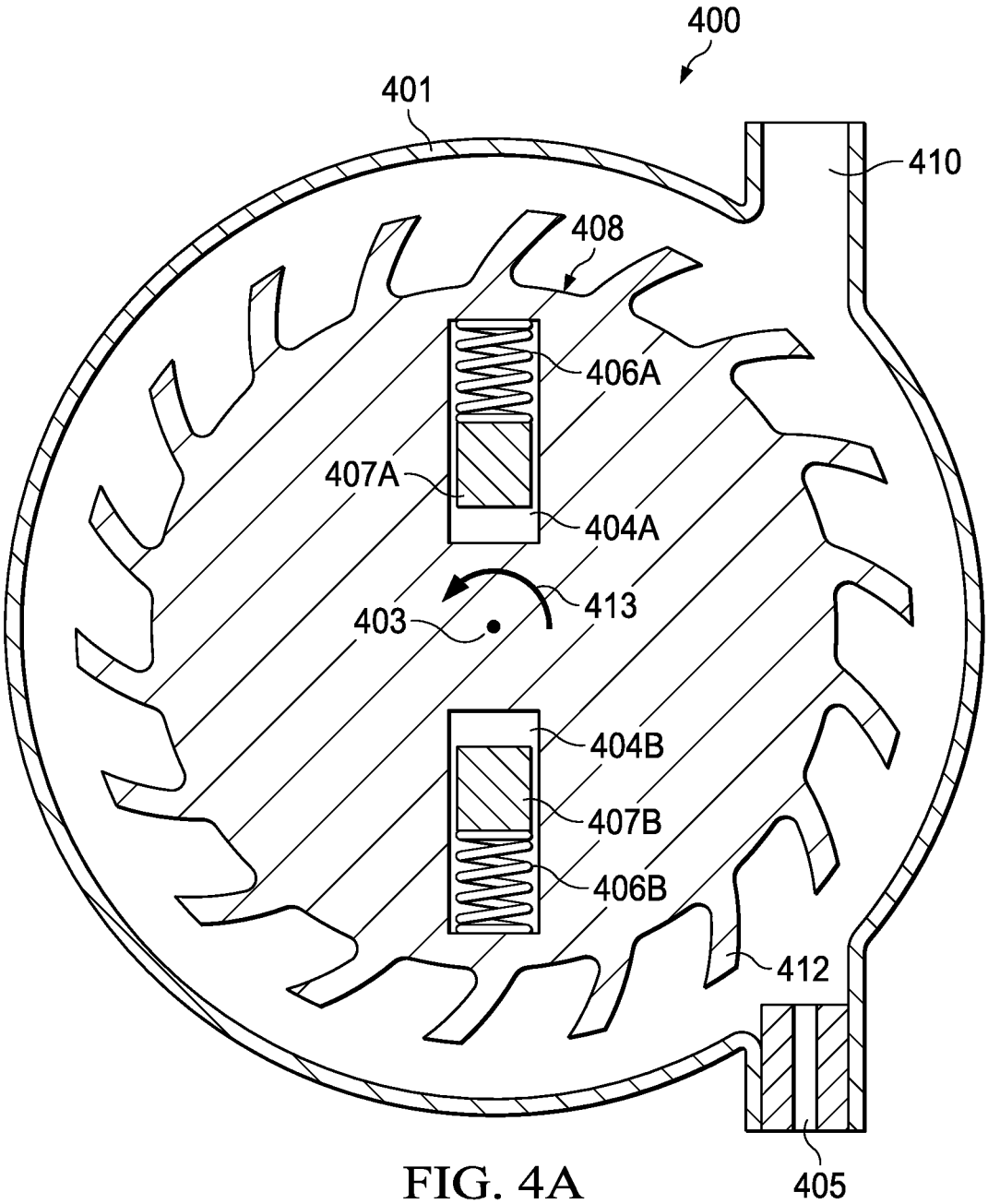
FIG. 4A is a cross-sectional view of another fluid flow control device having chambers that are partially filled with weights.

FIG. 4A is a cross-sectional view of another fluid flow control device 400 having chambers 404A and 404B that are partially filled with weights 407A and 407B. In the embodiment of FIG. 4A, fluid flow control device 400 includes a rotatable component 408 positioned within a housing 401 of fluid flow control device 400. Fluid flow control device 400 also includes an inlet port 405 that provides a fluid passage for fluids, such as, but not limited to, hydrocarbon resources, wellbore fluids, water, and other types of fluids to flow into housing 401. Some of the fluids that flow into housing 401 also come into contact with rotatable component 408, where force generated by fluids flowing onto rotatable component 408 rotates rotatable component 408 about an axis 403. In some embodiments, fluids flowing through inlet port 405 push against fins, including fin 412, which are coupled to rotatable component 408. Moreover, the force of the fluids against the fins rotate rotatable component 408 about axis 403. Two chambers 404A and 404B are positioned within fluid flow control device 400. In the embodiment of FIG. 4, each chamber 404A and 404B is filled with a weight 407A and 407B, respectively. Two springs 406A and 406B, which are positioned near or are coupled to weights 407A and 407B, are also placed within chambers 404A and 404B, respectively. As fluids flow out of inlet port 405, force of the fluids flowing onto the fins of rotatable component 408 rotates rotatable component 408 in a counterclockwise direction illustrated by arrow 413. Moreover, a centrifugal force generated by an increase in the rotational speed of rotatable component 408 radially shifts weights 407A and 407B outwards.

Figure 4B:
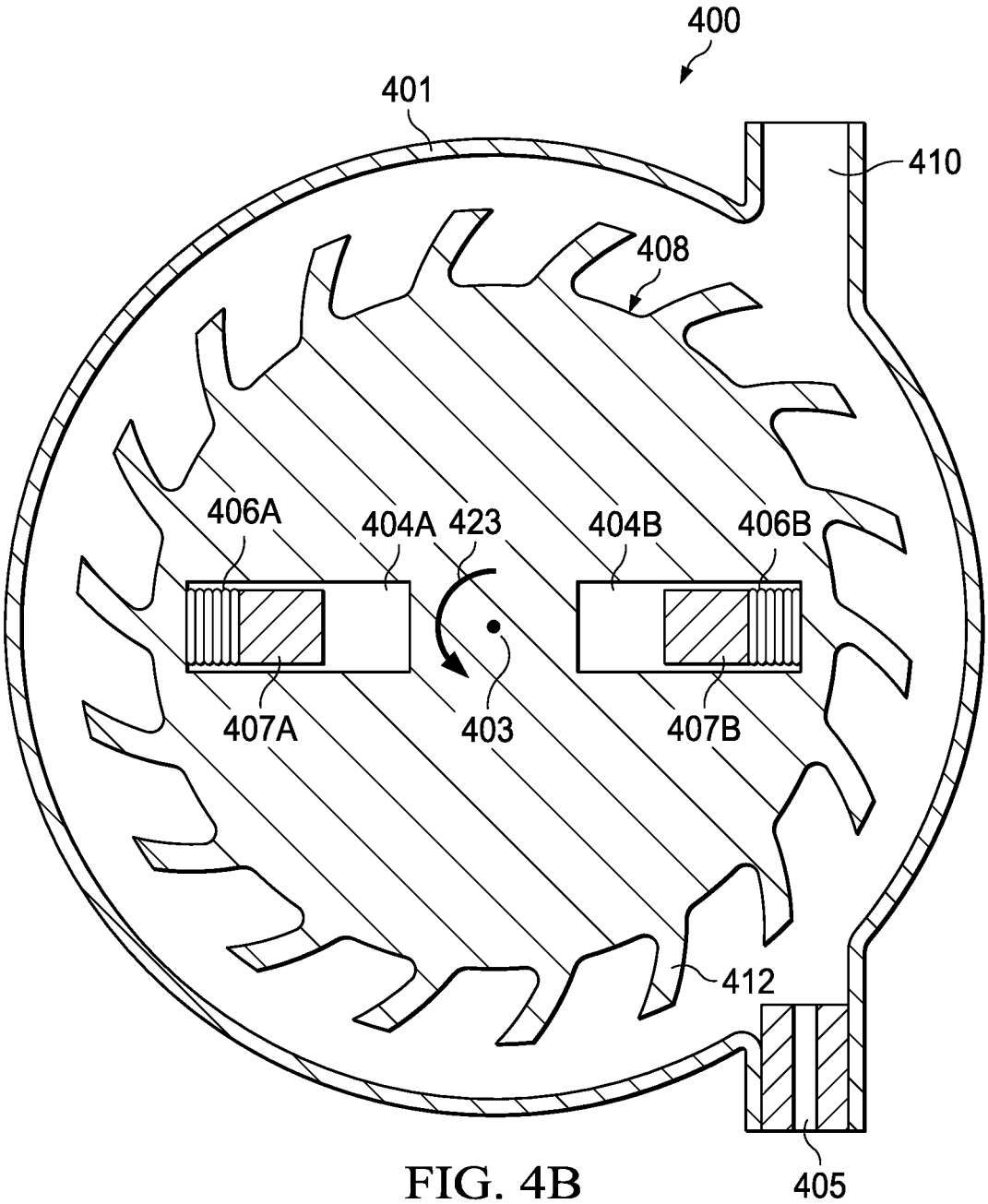
FIG. 4B is a cross-sectional view of the fluid flow control device of FIG. 4A, where the weights have shifted radially outwards in response to an increase in a rotational speed of a rotatable component of the fluid flow control device.

In that regard, FIG. 4B is a cross-sectional view of fluid flow control device 400 of FIG. 4A, where weights 407A and 407B have shifted radially outwards towards the parameter of rotatable component 408 in response to an increase in a rotational speed of rotatable component 408 of fluid flow control device 400. In the embodiment of FIG. 4B, as rotatable component 408 continues to rotate about axis 403 in a counterclockwise direction as indicated by arrow 423, the centrifugal force radially shifts weights 407A and 407B outwards, where weights 407A and 407B press against springs 406A and 406B, respectively, thereby compressing springs 406A and 406B. The movement of weights 407A and 407B from the positions illustrated in FIG. 4A to the positions illustrated in FIG. 4B, increases a radius of gyration of rotatable component 408, which dampens the acceleration of rotatable component 408 and/or reduces the rotational speed of rotatable component 408, thereby reducing overspeed of rotatable component 408.

Over time, as the speed of rotatable component 408 decreases, the force of compressed springs 406A and 406B onto weights 407A and 407B supersedes the centrifugal force generated by rotation of rotatable component 408, and shifts weights 407A and 407B radially inwards towards axis 403 and towards initial positions of weights 407A and 407B, as illustrated in FIG. 4A. In some embodiments, springs 406A and 406B and weights 407A and 407B are not placed in chambers 404A and 404B. Instead, chambers 404A and 404B are partially filled with fluids, such as water or fluids having a density that is greater than a threshold density. In one or more of such embodiments, as the rotatable component 408 rotates at a faster speed, a centrifugal force applied to the fluid shifts the fluid from a first region of the chamber, radially outwards, to a second region of the chamber that is further away from axis 403 of rotatable component 408 relative to the first region. The radially outward movement of the fluids from the first region to the second region of chambers 404A and 404B also increases the radius of gyration of rotatable component 408, which dampens the acceleration of rotatable component 408 and/or reduces the rotational speed of rotatable component 408, thereby reducing overspeed of rotatable component 408.

In the embodiment of FIGS. 4A and 4B, Fluid control device 400 also includes an outlet port 410 that provides a fluid flow path for fluids to flow out of fluid flow control device 400, such as to vortex valve 220 of FIG. 2. In some embodiments, weights 407A and 407B and fluids (not shown) shift or flow in response to rotatable component 408 accelerating at a rate that is above a threshold rate, but do not shift or flow if rotatable component 408 accelerates at a rate that is at or below the threshold rate. In some embodiments, weights 407A and 407B and fluids (not shown) shift or flow in response to rotatable component 408 rotating above a threshold speed, but do not shift or flow if rotatable component 408 rotates at a rate that is at or below the threshold rate. Although FIGS. 4A and 4B illustrate two chambers 404A and 404B, each filled with a weight 407A and 407B, respectively, and a spring 406A and 406B, respectively, in some embodiments, a different number of chambers having one or more weights and springs are placed on or inside rotatable component 408. In some embodiments, some of the chambers are partially filled with fluids, whereas other chambers contain one or more weights and springs. Further, although FIGS. 4A and 4B illustrate rotatable component 408 rotating in a counterclockwise direction, in some embodiments, rotatable component 408 also rotates in a clockwise direction.

Figure 5A:
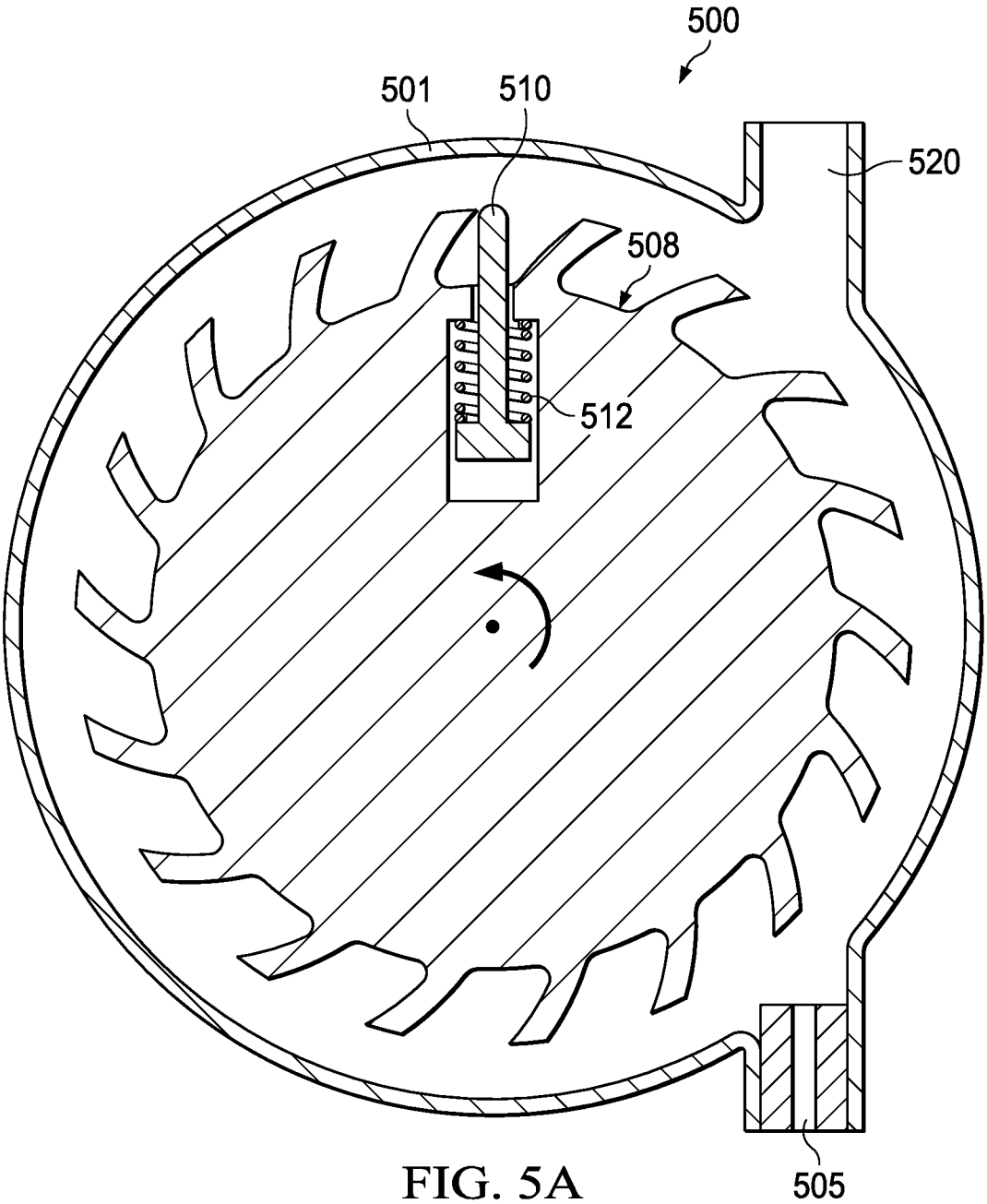
FIG. 5A is a cross-sectional view of another fluid flow control device having a protrusion that is extendable in a radial direction.

FIG. 5A is a cross-sectional view of another fluid flow control device 500 having a protrusion 510 that is extendable in a radial direction. In the embodiment of FIG. 5A, fluid flow control device 500, similar to fluid flow control device 400 shown in FIGS. 4A and 4B, also includes a rotatable component 508 positioned within a housing 501, an inlet port 505 that provides a fluid passage for fluids to flow into housing 501, and an outlet port 520 that provides a fluid flow path for fluids to flow out of fluid flow control device 500, such as to vortex valve 220 of FIG. 2. Fluid flow control device 500 also includes a protrusion 510 that is placed on top of rotatable component 508. In the embodiment of FIG. 5A, protrusion 510 is a pin that extends radially outwards towards a wall of a housing 501 of fluid flow control device 500.

Figure 5B:
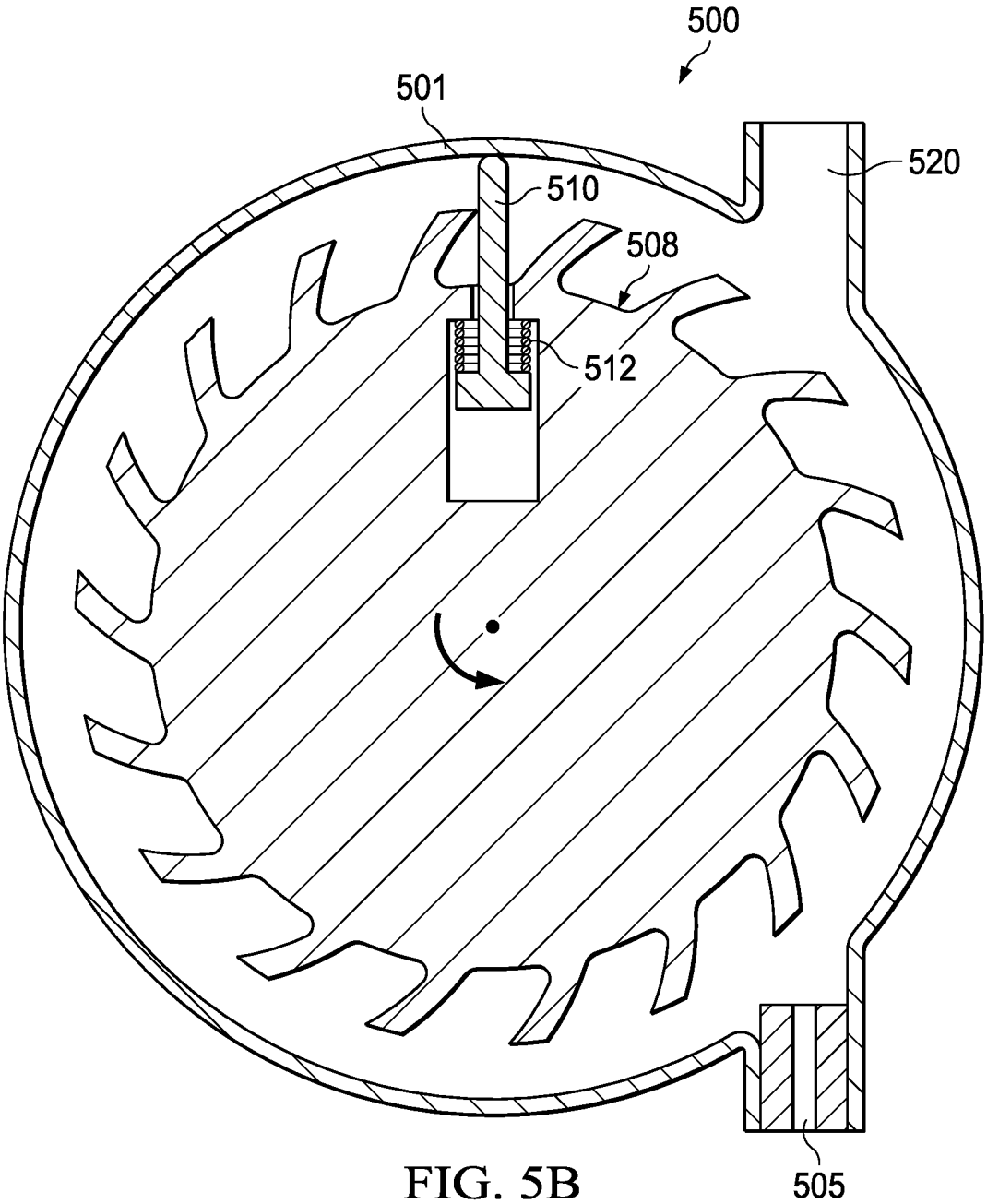
FIG. 5B is a cross-sectional view of the fluid flow control device of FIG. 5A, where the protrusion has extended radially outwards to engage the housing of the fluid flow control device in response to an increase in a rotational speed of a rotatable component of the fluid flow control device.

As fluids flow out of inlet port 505, force of the fluids flowing onto the fins of rotatable component 508 rotates rotatable component 508 about axis 503, and a centrifugal force generated by an increase in the rotational speed of rotatable component 508 radially shifts protrusion 510 outwards from the position illustrated in FIG. 5A to the position illustrated in FIG. 5B. Protrusion 510 also comes into contact with a spring 512, which is positioned near or coupled to protrusion 510, while protrusion 510 shifts from the first position illustrated in FIG. 5A to the second position illustrated in FIG. 5B, thereby compressing spring 512.

FIG. 5B is a cross-sectional view of the fluid flow control device of FIG. 5A, where protrusion 510 has extended radially outwards to engage a portion of housing 501 of fluid flow control device 500 in response to an increase in a rotational speed of rotatable component 508. In the embodiment of FIG. 5B, the engagement of protrusion 510 to a portion of the wall of housing 501, dampens the acceleration and/or reduces the rotational speed of rotatable component 508. As the rotational speed of rotatable component 508 decreases, for example due to protrusion 510 being engaged to the wall of housing 501, the force of compressed springs 512 onto protrusion 510 supersedes the centrifugal force generated by rotation of rotatable component 508, and shifts protrusion 510 radially inwards towards the initial position of protrusion 510 as illustrated in FIG. 5A.

Although FIGS. 5A and 5B illustrate protrusion 510 as a pin, in some embodiments, protrusion 510 is a screw, a rod, or another element or component that is shiftable from an initial position to a second position to engage another element of fluid flow control device 500 to dampen the acceleration and/or reduce the rotational speed of rotatable component 508. Further, although FIGS. 5A and 5B illustrate a single protrusion 510, in some embodiments, multiple protrusions are disposed on or inside rotatable component 508 and are extendable to dampen the acceleration and/or reduce the rotational speed of rotatable component 508. Further, although FIG. 5B illustrates protrusion 510 engaging a portion of the wall of housing 501, in some embodiments, protrusion 510 engages another element of another component of fluid flow control device 500. In some embodiments, protrusion 510 engages another protrusion that is formed on or coupled to a component of fluid flow control device 500, such as another protrusion that is formed on the wall of housing 501.

Figure 6A:
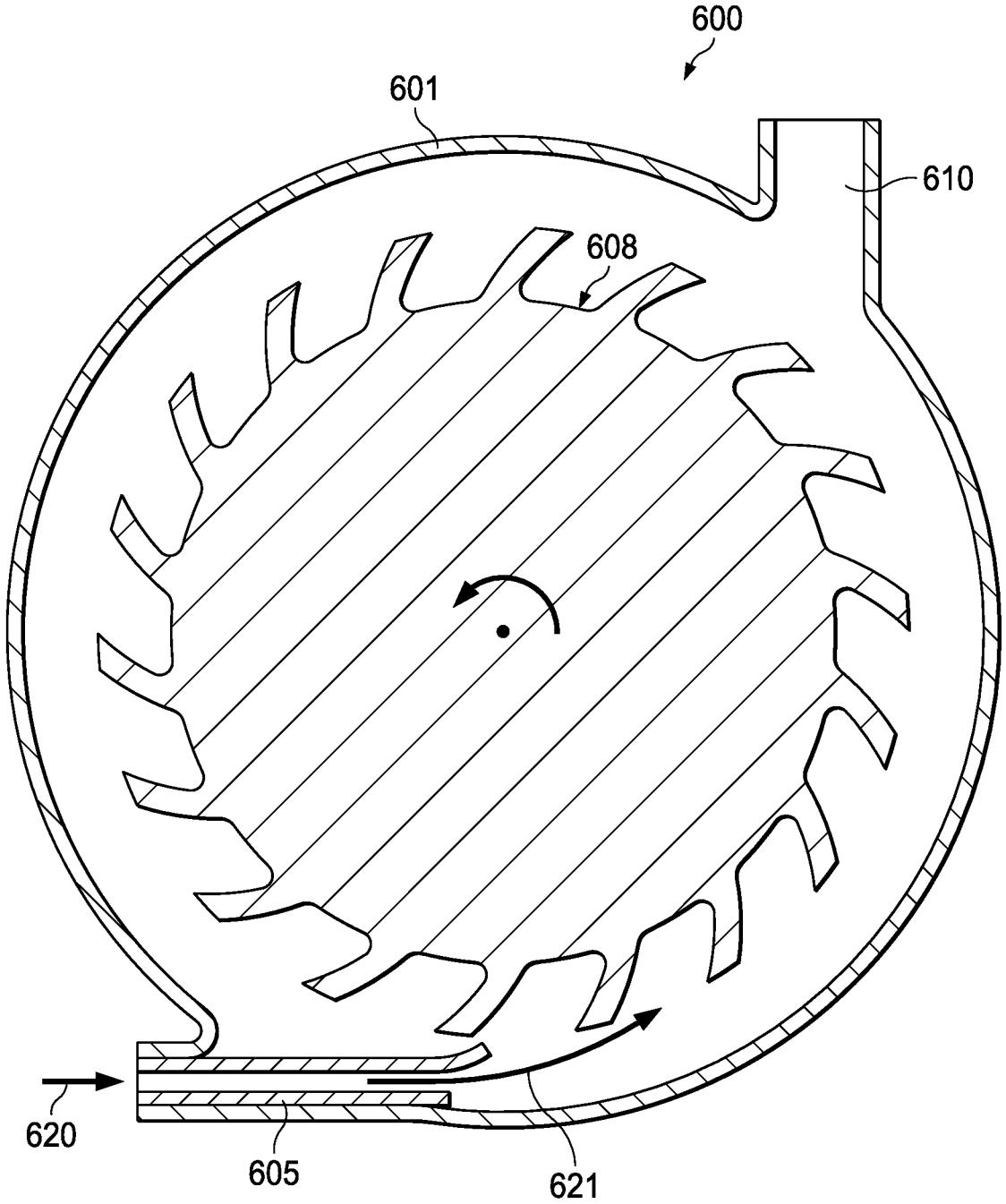
FIG. 6A is a cross-sectional view of another fluid flow control device having an inlet port, where fluids flow out of the inlet port at a first rate.

FIG. 6A is a cross-sectional view of another fluid flow control device 600 having an inlet port 605, where fluids flow out of the inlet port 605 at a first rate. In the embodiment of FIG. 6A, fluid flow control device 600, similar to fluid flow control devices 400 and 500, also includes a rotatable component 608 positioned within a housing 601, and an inlet port 605 that provides a fluid passage for fluids to flow into housing 601, and an outlet port 610 that provides a fluid flow path for fluids to flow out of fluid flow control device 400, such as to vortex valve 220 of FIG. 2. Moreover, fluids flow into rotatable component 608 in a direction illustrated by arrow 620, and flow out of rotatable component 608 in a direction illustrated by arrow 621, where a portion of the fluids experience a Coanda effect, and flows onto fins of rotatable component 608, thereby rotating rotatable component 608.

Figure 6B:
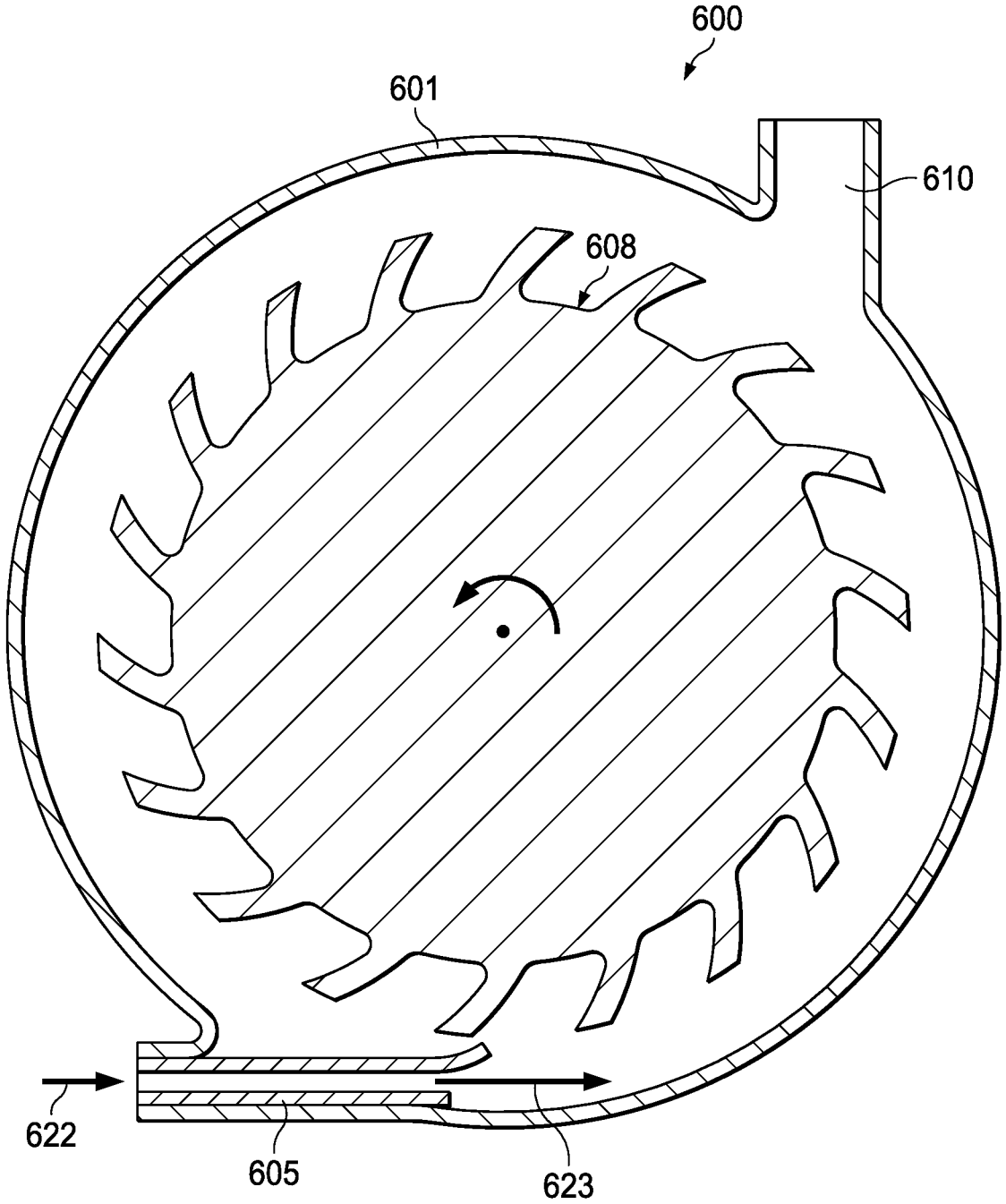
FIG. 6B is a cross-sectional view of the fluid flow control device of FIG. 6A, where the flow rate of fluids flowing out of the inlet port is increased to a second rate in response to an increase in the rotational speed of rotatable component being greater than a threshold rotational speed.

FIG. 6B is a cross-sectional view of the fluid flow control device of FIG. 6A, where the flow rate of fluids flowing out of inlet port 605 is increased to a second rate in response to an increase in the rotational speed of rotatable component 608 being greater than a threshold rotational speed. In the embodiment of FIG. 6B, the increase in flow rate of fluid flow out of inlet conduit 605 reduces the Coanda effect. As shown in FIG. 6B, fluids flow in a direction illustrated by arrow 622 into inlet port 605, and out of inlet port 605 in a direction illustrated by arrow 623, which is more parallel to inlet port 605 relative to arrow 621 shown in FIG. 6A to indicate a reduction of the Coanda effect on the fluids.

In some embodiments, pressure is applied to the fluids to increase the flow rate of the fluids flowing out of inlet port 605. In some embodiments, a nozzle (not shown) is coupled to inlet port 605 to increase the flow rate out of inlet port 605. In one or more of such embodiments, the flow rate of the fluids is increased to a first threshold rate in response to the speed of rotatable component 608 being greater than a threshold rotational speed. In some embodiments, the flow rate of the fluids are reduced to a second threshold rate that is less than the first threshold rate in response to the speed of rotatable component 608 being greater than a threshold rotational speed, thereby reducing the total amount of fluids flowing into housing 601, which in turn reduces the amount of fluids that flow onto rotatable component 608 to rotate rotatable component 608.

Figure 7A:
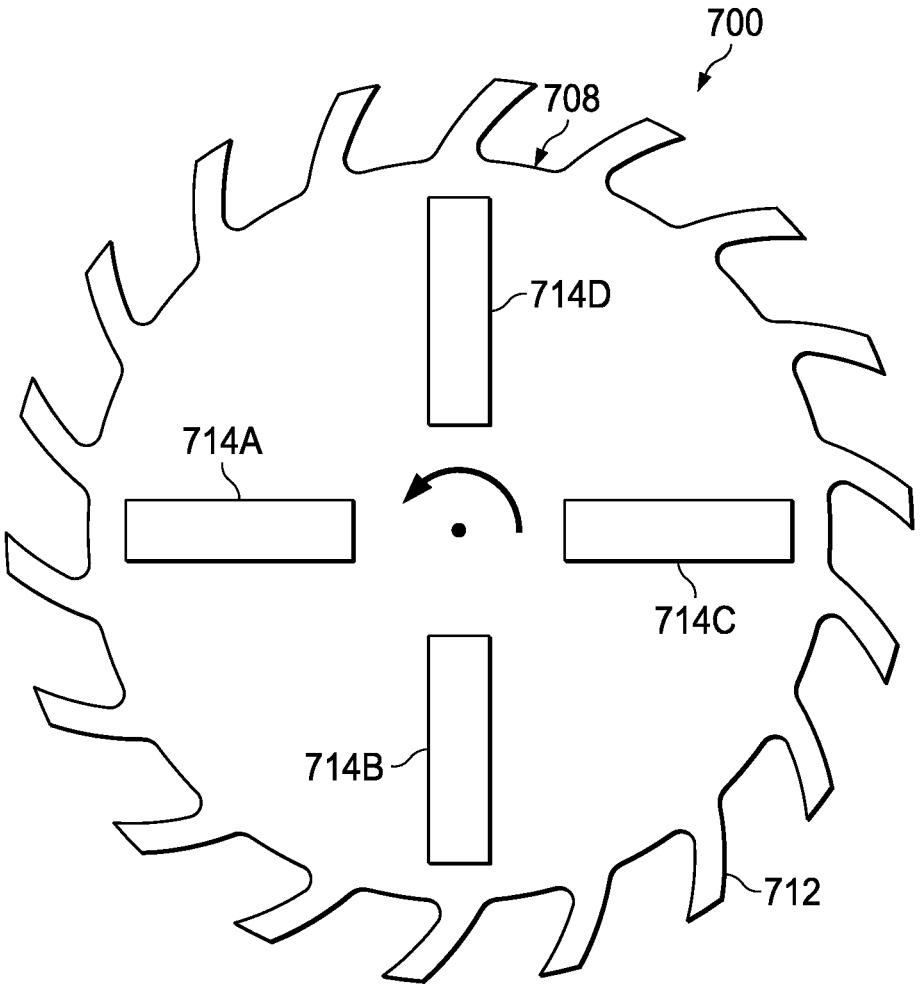
FIG. 7A is an overhead view of another fluid flow control device having four top fins placed on top of a rotatable component of the fluid flow control device.
Figure 7B:
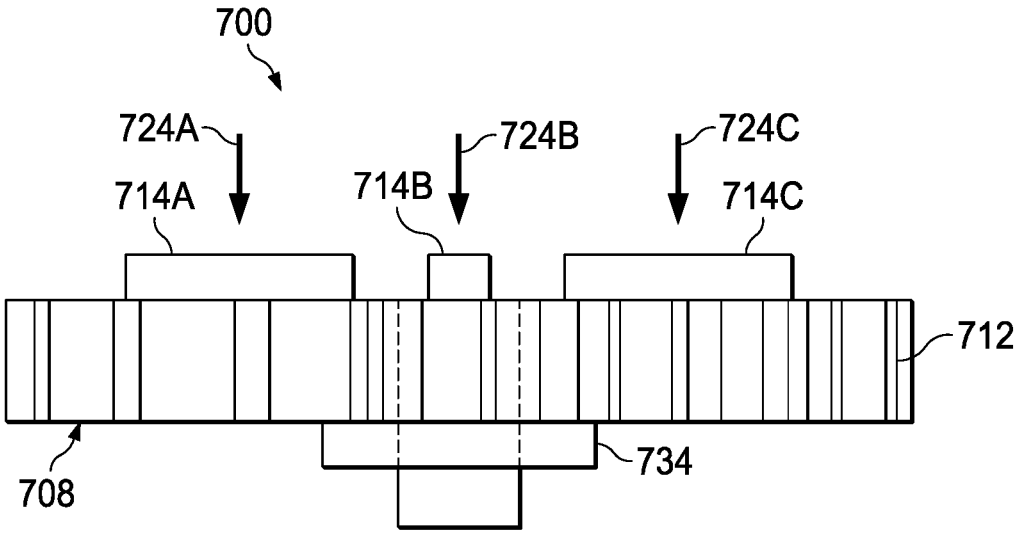
FIG. 7B is a side view of the fluid flow control device of FIG. 7A.

FIG. 7A is an overhead view of another fluid flow control device 700 having four top fins 714A-714D placed on top of a rotatable component 708 of the fluid flow control device 700. Further, FIG. 7B is a side view of the fluid flow control device 700 of FIG. 7A, in which, rotatable component 708 is placed on top of a thrust bearing 734. In the embodiment of FIGS. 7A and 7B, force applied by fluids onto fins of rotatable component 708, such as fin 712, rotates rotatable component 708. Top fins 714A-714D are angled at a pitch such that as rotatable component 708 rotates, top fins 714A-71C generate a resultant downward force as indicated by arrows 724A-724C, which pushes rotatable component 708 against a thrust bearing 734, on which, rotatable component 708 rotates. As the rotatable speed of rotatable component 708 increases, downward force also increases, which in turn further increases friction between thrust bearing 734 and rotatable component 708. Although FIG. 7A illustrates four top fins 714A-714D, in some embodiments, a different number of top fins are placed on top of rotatable component 708.

Figure 8A:
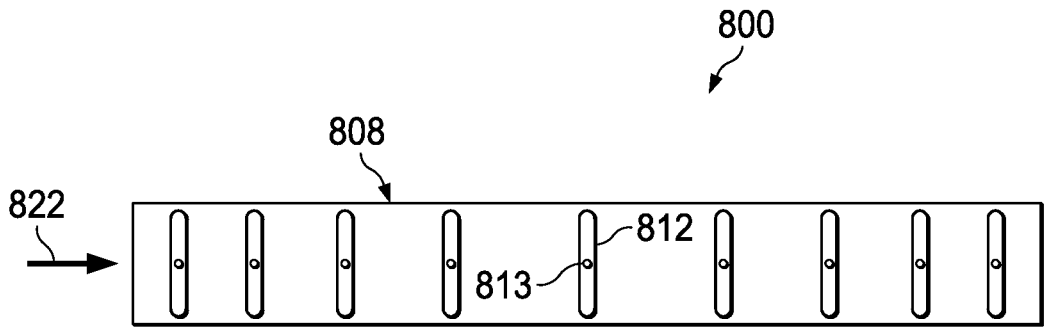
FIG. 8A is a side view of another type of fluid flow control device having a rotatable component that is fitted with adjustable fins.
Figure 8B:
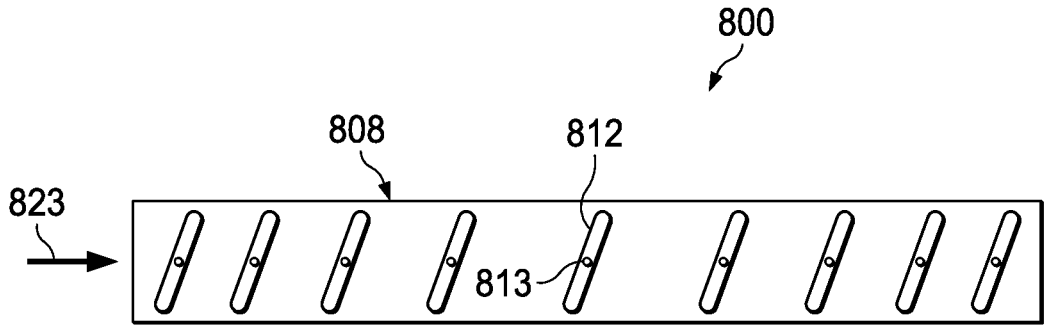
FIG. 8B is a side view of the fluid flow control device of FIG. 8A, where the pitches of the fins of the of rotatable component are adjusted in response to a force generated by fluids coming into contact with the fins.

FIG. 8A is a side view of another type of fluid flow control device 800 having a rotatable component 808 that is fitted with adjustable fins, including fin 812. In the embodiment of FIG. 8A, each fin is rotatable about a hinge, such as hinge 813. Further, the fins are initially oriented in a direction that is substantially perpendicular to a direction of a stream of fluids as indicated by arrow 822. Force applied by the fluids flowing onto fins, such as fin 812, rotates the fins about their respective hinges. In that regard, FIG. 8B is a side view of fluid flow control device 800 of FIG. 8A, where the pitches of the fins of rotatable component 808 are adjusted in response to the force generated by fluids coming into contact with the fins. As illustrated in FIG. 8B, fin 812 has rotated about hinge 813 such that fin 812 is no longer approximately perpendicular to the direction of the stream of fluids as indicated by arrow 823, thereby reducing the amount of fluids that comes into contact with fin 812, dampening the acceleration and/or reducing the rotational speed of rotatable component 808.

In the embodiment of FIG. 8A, each fin has a pitch that is approximately 0°, indicating that the longitudinal surface of the fin is approximately perpendicular to the top surface of rotatable component 808. Further, in the embodiment of FIG. 8B, each fin has a pitch that is approximately 45°. In the embodiment of FIGS. 8A-8B, a fin has a pitch of approximately 90° if the fin longitudinal surface of the pin is approximately parallel to the top surface of rotatable component 808. In some embodiments, the degree of a pitch of the fins is determined in reference to another component of fluid flow control device 800. In some embodiments, the fins of rotatable component 808 are coupled to a spring, a tension, or another mechanism that applies a force to rotate the fins back an initial orientation or pitch (such as the orientation or pitch of fin 812 illustrated in FIG. 8A) if less than a threshold of force is applied to the respective fins.

Figure 9:
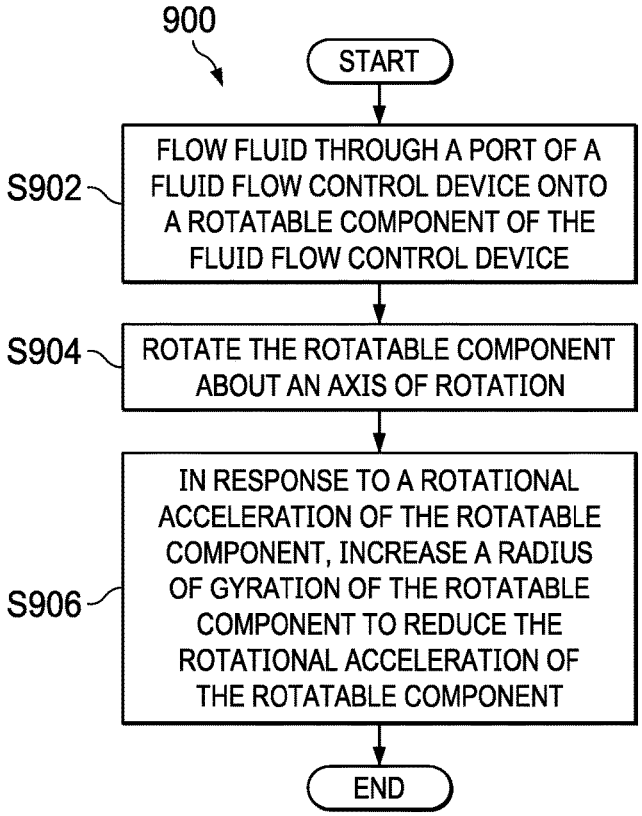
FIG. 9 is a flowchart of a process to reduce overspeed of a fluid flow control device.

FIG. 9 is a flowchart of a process 900 to reduce overspeed of a fluid flow control device. Although the operations in the process 900 are shown in a particular sequence, certain operations may be performed in different sequences or at the same time where feasible.

At block S902, fluid flows through a port of a fluid flow control device onto a rotatable component of the fluid flow control device. FIGS. 4A-4B, for example, illustrate inlet port 405, through which fluids flow onto rotatable component 408 of fluid flow control device 400. At block S904, the rotatable component is rotated about an axis of rotation. FIGS. 4A-4B, for example, illustrate rotatable component 408 rotating about axis 403. At block S906, and in response to a rotational acceleration of the rotatable component, a radius of gyration of the rotatable component is increased to reduce the rotational acceleration of the rotatable component. FIGS. 4A-4B, for example, illustrate weights 407A and 407B shifting from initial positions illustrated in FIG. 4A, away from axis 403, and to positions illustrated in FIG. 4B. The movement of weights 407A and 407B away from axis 403 and towards the parameter of rotatable component 408 increases the radius of gyration of rotatable component 408, which in turn reduces the rotational acceleration of the rotatable component. In some embodiments, fluids that are partially filled in chambers are utilized to increase of gyration of rotatable component 408. In some embodiments, the flow rate of fluids flowing through an inlet port of the fluid flow control device is increased, such as to a first threshold rate to reduce a Coanda effect on the fluids, thereby reducing the speed of the rotatable component. Alternatively, in some embodiments, the flow rate of fluids flowing through an inlet port is reduced to a second threshold rate that is less than the first threshold rate to reduce the speed of the rotatable component.

Figure 10:
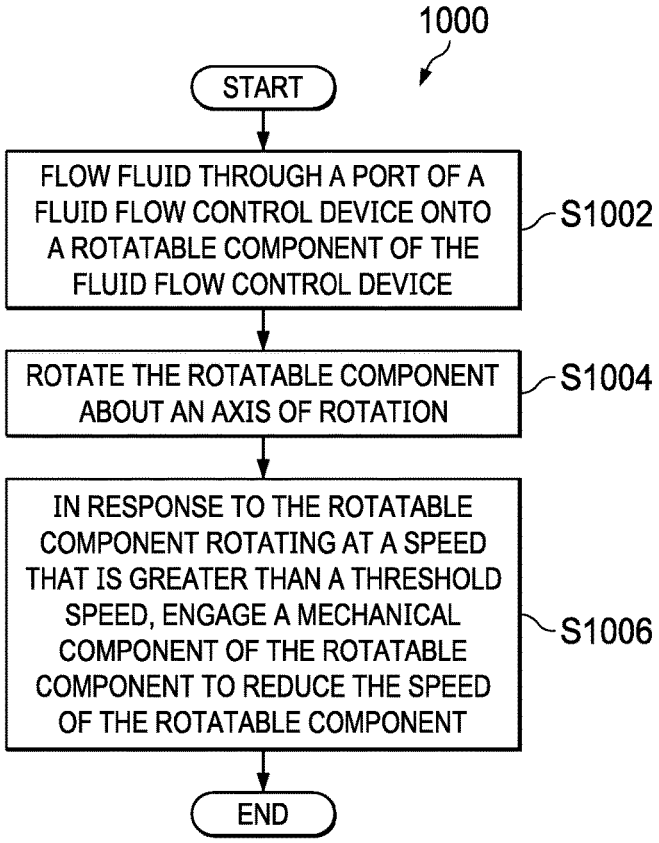
FIG. 10 is a flowchart of another process to reduce overspeed of a fluid flow control device.

FIG. 10 is a flowchart of another process 1000 to reduce overspeed of a fluid flow control device. Although the operations in the process 1000 are shown in a particular sequence, certain operations may be performed in different sequences or at the same time where feasible.

At block S1002, fluid flows through a port of a fluid flow control device onto a rotatable component of the fluid flow control device. FIGS. 5A-5B, for example, illustrate inlet port 505, through which fluids flow onto rotatable component 508 of fluid flow control device 500. Similarly, FIGS. 6A-6B illustrate inlet port 605, through which fluids flow onto rotatable component 608 of fluid flow control device 600. Further, FIGS. 7A-7B illustrate inlet port 705, through which fluids flow onto rotatable component 708 of fluid flow control device 700. At block S1004, the rotatable component is rotated about an axis of rotation. FIGS. 5A-5B, for example, illustrate rotatable component 508 rotating about axis 503. At block S1006, and in response to the rotatable component rotating at a speed that is greater than a threshold speed, a mechanical component of the rotatable component is engaged to reduce the speed of the rotatable component. In the embodiment of FIGS. 5A-5B, the mechanical is a protrusion 510. Moreover, protrusion 510 is engaged by being shifted radially outwards from the position illustrated in FIG. 5A to the position illustrated in FIG. 5B to engage a portion of the wall of housing 501, thereby reducing the rotational speed of rotatable component 508. In the embodiment of FIGS. 7A-7B, the mechanical component is a top fin, such as top fin 714A. Moreover, top fin 714A is installed on rotatable component 708 of FIGS. 7A and 7B at a pitch (e.g., 30°, 45°, or another pitch), such that, as rotatable component 708 rotates, a resultant downward force pushes rotatable component against thrust bearing 734 of FIG. 7B in a direction illustrated by arrow 724A of FIG. 7B, which increases the friction between rotatable component 708 and thrust bearing 734, thereby reducing the rotational speed of rotatable component 708. In the embodiment of FIGS. 8A-8B, the mechanical component is a fin of rotatable component 808, such as fin 812. Moreover, fin 812 is engaged by rotating fin 812 from having a first pitch as illustrated in FIG. 8A to having a pitch as illustrated in FIG. 8B, thereby reducing the rotational speed of rotatable component 808. In some embodiments, the flow rate of fluids flowing through an inlet port of the fluid flow control device is increased, such as to a first threshold rate to reduce a Coanda effect on the fluids, thereby reducing the speed of the rotatable component. Alternatively, in some embodiments, the flow rate of fluids flowing through an inlet port is reduced to a second threshold rate that is less than the first threshold rate to reduce the speed of the rotatable component.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For instance, although the flowcharts depict a serial process, some of the steps/processes may be performed in parallel or out of sequence, or combined into a single step/process. The scope of the claims is intended to broadly cover the disclosed embodiments and any such modification. Further, the following clauses represent additional embodiments of the disclosure and should be considered within the scope of the disclosure.

Clause 1, a fluid flow control device, comprising: a port; a rotatable component that rotates about an axis in response to fluid flow from the port; and a mechanical component disposed on the rotatable component and configured to reduce rotational speed of the rotatable component.

Clause 2, the fluid flow control device of clause 1, wherein the mechanical component is a protrusion that extends radially outwards from a first position towards a second position in response to an increase in rotational speed of the rotatable component, and wherein the protrusion is configured to engage an element of the fluid flow control device while the protrusion is in the second position to reduce the rotational speed of the rotatable component.

Clause 3, the fluid flow control device of clause 2, further comprising a spring that is coupled to the protrusion, wherein the spring is in a natural state while the protrusion is in the first position, and wherein the spring is in a compressed state while the protrusion is in the second position.

Clause 4, the fluid flow control device of clause 3, wherein the spring is configured to shift the protrusion from the second position to the first position while the rotational speed of the rotatable component is below a threshold speed.

Clause 5, the fluid flow control device of clause 1, wherein the mechanical component is a top fin positioned on top of the rotatable component at a pitch, and wherein the top fin generates a downward force on the rotatable component in response to an increase in the rotational speed of the rotatable component.

Clause 6, the fluid flow control device of clause 1, wherein the mechanical component is a fin that extends outwards from the rotatable component, and wherein the fin has a variable pitch that is based on the rotational speed of the rotatable component.

Clause 7, the fluid flow control device of clause 6, wherein the fin is configured to rotate from having a first pitch to having a second pitch in response to an increase in the rotational speed of the rotatable component.

Clause 8, a fluid flow control device, comprising: a port; a rotatable component that rotates about an axis in response to fluid flow from the port; and a chamber disposed within the fluid flow control device and containing an element that moves away from the axis in response to a rotational acceleration of the rotatable component, wherein movement of the element away from the axis increases a radius of gyration of the rotatable component.

Clause 9, the fluid flow control device of clause 8, wherein the element is a weight that shifts from a first position in the chamber to a second position in the chamber that is further away from the axis relative to the first position in response to a rotational acceleration of the rotatable component.

Clause 10, the fluid flow control device of clause 9, further comprising a spring that is in a natural state while the weight is in the first position and is in a compressed state while the weight is in a second position.

Clause 11, the fluid flow control device of clause 10, wherein the spring is configured to shift the weight from the second position to the first position while the rotational acceleration of rotatable component is below a threshold rate.

Clause 12, the fluid flow control device of clause 8, wherein the element is a fluid that partially fills the chamber, and wherein the fluid flows from a first region of the chamber to a second region of the chamber further away from the axis relative to the first region in response to the rotational acceleration of the rotatable component.

Clause 13, a method to reduce overspeed of a fluid flow control device, the method comprising: flowing fluid through a port of a fluid flow control device onto a rotatable component of the fluid flow control device; rotating the rotatable component about an axis of rotation; and in response to a rotational acceleration of the rotatable component, increasing a radius of gyration of the rotatable component to reduce the rotational acceleration of the rotatable component.

Clause 14, the method of clause 13, further comprising shifting an element disposed within a chamber of the fluid flow control device away from the axis of rotation to increase the radius of gyration of the rotatable component.

Clause 15, the method of clauses 13 or 14, further comprising increasing a flow rate of the fluid out of the inlet port to reduce the rotational acceleration of the rotatable component.

Clause 16, a method to reduce overspeed of a fluid flow control device, the method comprising: flowing fluid through a port of a fluid flow control device onto a rotatable component of the fluid flow control device; rotating the rotatable component about an axis of rotation; and in response to the rotatable component rotating at a speed that is greater than a threshold speed, engaging a mechanical component of the rotatable component to reduce the speed of the rotatable component.

Clause 17, the method of clause 16, wherein the mechanical component is a protrusion that extends radially outwards from the rotatable component, and wherein engaging the mechanical component comprises shifting the protrusion radially outwards from a first position towards a second position to engage an element of the fluid flow control device to reduce the speed of the rotatable component.

Clause 18, the method of clauses 16 or 17, wherein the mechanical component is a top fin positioned on top of the rotatable component, and wherein the top fin wherein the top fin generates a downward force on the rotatable component in response to an increase in the rotational speed of the rotatable component to reduce the speed of the rotatable component.

Clause 19, the method of any of clauses 16-18, wherein the mechanical component is a fin that extends outwards from the rotatable component, wherein the fin has a variable pitch that is based on the speed of the rotatable component, and wherein engaging the mechanical component comprises rotating the fin from having a first pitch to having a second pitch to reduce the speed of the rotatable component. As used herein, the singular forms "a," "an," and "the" are intended to include the plural forms as well, unless the context clearly indicates otherwise. It will be further understood that the terms "comprise" and/or "comprising," when used in this specification and/or in the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

What is claimed is:

1. A fluid flow control device, comprising:

a port;

a rotatable component that rotates about an axis in response to fluid flow from the port; and a mechanical component disposed on the rotatable component and configured to reduce rotational speed of the rotatable component, wherein the mechanical component is a top fin positioned on top of the rotatable component at a pitch, and wherein the top fin generates a downward force on the rotatable component in response to an increase in the rotational speed of the rotatable component.

2. The fluid flow control device of claim 1, wherein the mechanical component is a protrusion that extends radially outwards from a first position towards a second position in response to an increase in rotational speed of the rotatable component, and wherein the protrusion is configured to engage an element of the fluid flow control device while the protrusion is in the second position to reduce the rotational speed of the rotatable component.

3. The fluid flow control device of claim 2, further comprising a spring that is coupled to the protrusion, wherein the spring is in a natural state while the protrusion is in the first position, and wherein the spring is in a compressed state while the protrusion is in the second position.

4. The fluid flow control device of claim 3, wherein the spring is configured to shift the protrusion from the second position to the first position while the rotational speed of the rotatable component is below a threshold speed.

5. The fluid flow control device of claim 1, wherein the mechanical component is a fin that extends outwards from the rotatable component, and wherein the fin has a variable pitch that is based on the rotational speed of the rotatable component.

6. The fluid flow control device of claim 5, wherein the fin is configured to rotate from having a first pitch to having a second pitch in response to an increase in the rotational speed of the rotatable component.

7. A fluid flow control device, comprising:

a port;

a rotatable component that rotates about an axis in response to fluid flow from the port;

a chamber disposed within the fluid flow control device and containing an element that moves away from the axis in response to a rotational acceleration of the rotatable component, wherein movement of the element away from the axis increases a radius of gyration of the rotatable component; and a top fin positioned on top of the rotatable component at a pitch, and wherein the top fin generates a downward force on the rotatable component in response to an increase in the rotational speed of the rotatable component.

8. The fluid flow control device of claim 7, wherein the element is a weight that shifts from a first position in the chamber to a second position in the chamber that is further away from the axis relative to the first position in response to a rotational acceleration of the rotatable component.

9. The fluid flow control device of claim 8, further comprising a spring that is in a natural state while the weight is in the first position and is in a compressed state while the weight is in a second position.

10. The fluid flow control device of claim 9, wherein the spring is configured to shift the weight from the second position to the first position while the rotational acceleration of rotatable component is below a threshold rate.

11. The fluid flow control device of claim 7, wherein the element is a fluid that partially fills the chamber, and wherein the fluid flows from a first region of the chamber to a second region of the chamber further away from the axis relative to the first region in response to the rotational acceleration of the rotatable component.

12. A method to reduce overspeed of a fluid flow control device, the method comprising:

flowing fluid through a port of a fluid flow control device onto a rotatable component of the fluid flow control device;

rotating the rotatable component about an axis of rotation; and in response to an increase to a rotational speed of the rotatable component, generating a downward force by a top fin positioned on top of the rotatable component on the rotatable component to reduce the rotational speed of the rotatable component.

13. The method of claim 12, further comprising increasing a flow rate of the fluid out of the port to reduce the rotational acceleration of the rotatable component.

14. The method of claim 12, further comprising in response to a rotational acceleration of the rotatable component, increasing a radius of gyration of the rotatable component to reduce the rotational acceleration of the rotatable component.

15. A method to reduce overspeed of a fluid flow control device, the method comprising:

flowing fluid through a port of a fluid flow control device onto a rotatable component of the fluid flow control device;

rotating the rotatable component about an axis of rotation; and in response to the rotatable component rotating at a speed that is greater than a threshold speed, engaging a mechanical component of the rotatable component to reduce the speed of the rotatable component, wherein the mechanical component is a top fin positioned on top of the rotatable component, and wherein the top fin generates a downward force on the rotatable component in response to an increase in the rotational speed of the rotatable component to reduce the speed of the rotatable component.

16. The method of claim 15, wherein the mechanical component is a protrusion that extends radially outwards from the rotatable component, and wherein engaging the mechanical component comprises shifting the protrusion radially outwards from a first position towards a second position to engage an element of the fluid flow control device to reduce the speed of the rotatable component.

17. The method of claim 15, wherein the mechanical component is a fin that extends outwards from the rotatable component, wherein the fin has a variable pitch that is based on the speed of the rotatable component, and wherein engaging the mechanical component comprises rotating the fin from having a first pitch to having a second pitch to reduce the speed of the rotatable component.

18. The method of claim 15, further comprising increasing a flow rate of the fluid flowing through the port to reduce the speed of the rotatable component.

19. The method of claim 18, further comprising shifting an element disposed within a chamber of the fluid flow control device away from the axis of rotation to increase the radius of gyration of the rotatable component.

* * * * *